United States Patent [19]

Tilse et al.

[11] 3,950,938

[45] Apr. 20, 1976

[54] TWO CONDUCTOR HAIRSPRING-HUB ARRANGEMENT FOR ELECTRIC WATCHES

[75] Inventors: Wilhelm Tilse, Birkenfeld, Germany; Jean Suard, Besancon, France; Patrick de Havilland Champion, Bucks, England

[73] Assignee: Timex Corporation, Waterbury, Conn.

[22] Filed: Feb. 24, 1975

[21] Appl. No.: 552,469

[30] Foreign Application Priority Data

May 6, 1974 Germany ..... 2421751

[52] U.S. Cl. ..... 58/114; 29/177; 58/28 B

[51] Int. Cl.[2] ..... G04C 3/04; G04B 17/06

[58] Field of Search ..... 29/177; 58/28 R, 28 A, 58/28 B, 107, 114

[56] References Cited

UNITED STATES PATENTS 3,528,237 9/1970 Suard ..... 58/114 X 3,553,956 1/1971 Schwartz et al. ..... 58/114 X

*Primary Examiner*—Edith Simmons Jackmon

[57] ABSTRACT

The two conductor hairspring-hub arrangement comprises a metallic and substantially conventional hairspring which is fastened to a unitary hub, i.e. a metallic washer-like hub, to form a core or inner conductor. This inner conductor is sheathed with an insulating mantle or layer which is, in turn, coated with an electrical conductive mantle, i.e. an outer conductor insulated from the inner conductor.

The insulating and conductive mantles have openings so that separate electrical connection can be made to the inner and outer conductors at each end of the hairspring-hub arrangement.

In this manner, a two conductor hairspring-hub arrangement is provided which in an electric watch is capable of coupling drive pulses to a balance wheel drive coil.

6 Claims, 3 Drawing Figures

TWO CONDUCTOR HAIRSPRING-HUB ARRANGEMENT FOR ELECTRIC WATCHES

FIELD OF THE INVENTION

This invention relates to electric or electronic watches and in particular to a current conductive hairspring arrangement therefore.

BACKGROUND OF THE INVENTION

With the emergence of the electric or electronic watch having a balance wheel as its main or central timekeeping element actuated by a drive coil mounted thereon, an inexpensive and reliable arrangement is needed to electrically connect the oscillating drive coil to the electric watch drive and/or synchronizing circuitry.

A known arrangement to connect the drive coil to the electric watch drive circuitry is described in German Pat. No. 1,078,677 issued Sept. 22, 1960 to Ewald Zemla. In this arrangement, the hairspring consists of three flat layers, i.e. two electrically conductive strips with an insulation strip therebetween. The hub consists of an insulating bushing, which is slipped onto the balance wheel arbor or staff, and two metallic ring halves surrounding the insulating bushing. The ring halves form a slot to receive one end of the hairspring, whereby its conductor strips are each connected to a ring half of the hub. Although a round or oval type of hairspring is shown, no arrangement is shown or suggested for fastening the hairspring to the hub. The obvious disadvantages of this known arrangement are that it requires a complicated and expensive hub construction and that great care must be taken when fastening the hairspring in the hub so that the conductor strips do not suffer damage.

The prior art also includes U.S. Patent No. 3,332,229 issued July 25, 1967 to Klinck and U.S. Pat. No. 3,553,956 issued Jan. 12, 1971 to Schwartz, Wurmberg and Weise. The above mentioned patents are mentioned as being representative of the prior art only and other pertinent patents may exist. None of the above cited patents are deemed to effect the patentability of the present invention.

It is an objective of the present invention to provide a two conductor hairspring and hub arrangement, which arrangement or device will be relatively low in cost and will utilize relatively few parts.

Further advantages and objectives of the present invention will be apparent from the following detailed description of the preferred embodiments of the invention.

SUMMARY OF THE INVENTION

A two conductor hairspring-hub arrangement for an electric watch of the type having a hairspring fastened at an inner end to a hub, wherein the improvement comprises a unitary hub, a hairspring being fastened to said unitary hub, said hairspring and hub comprising an inner conductor of said arrangement, a joint insulating mantle surrounding said inner conductor and having an aperture therein at least in an area of said hub and at an outer end of said hairspring, and means coating said joint insulating mantle for forming an outer conductor insulated from said inner conductor, said outer conductor being so formed such that separate electrical connection can be made with said inner and outer conductors at least in the areas of said hub and outer end of said hairspring wherein said apertures are being provided.

The accompanying drawings diagrammatically illustrate an embodiment of the present invention by way of example. Like numerals refer to like parts throughout.

Figure 1:
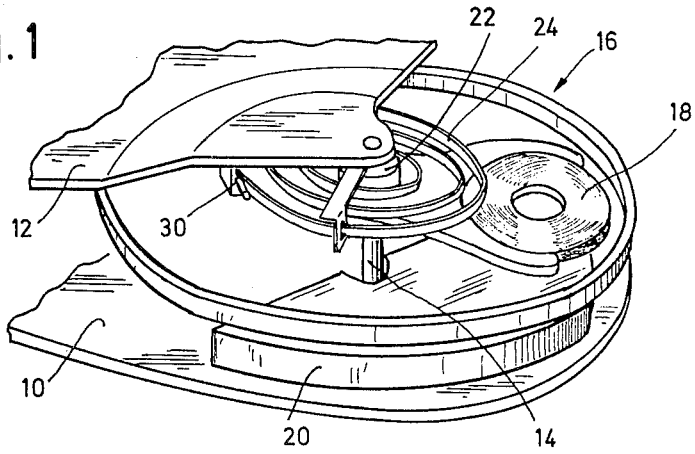
FIG. 1 is a perspective view of a part of an electric wristwatch having a balance wheel and hairspring arrangement.

Referring now to FIG. 1, the pertinent part of an electric wristwatch for purposes of illustrating the present invention is shown. The balance wheel unit 16, which includes an electric coil 18, is affixed to an arbor or staff 14. The staff 14 is rotatably mounted between a front frame 10 and a bridge member 12. The staff 14 has affixed thereto a so-called hairspring hub 22, to which the inner end of the hairspring 24 is fastened. The hairspring 24 is passed through an opening of a so-called regulator, which is rotatably mounted with respect to the bridge member 12 and coaxially to the staff 14. The outer end of the hairspring is fastened 30 to the bridge member 12 in a conventional manner. The electric coil 18, which cooperates with a permanent magnet 20 fastened on the front frame 10, functions conventionally to provide the drive and/or synchronizing force to the balance wheel unit 16 and, therefore, is not described further to avoid prolixity.

Figure 2:
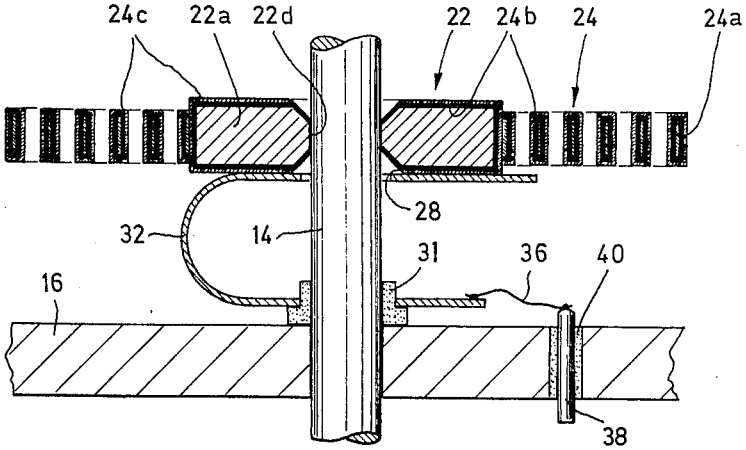
FIG. 2 is an axial cross sectional view of a prefered construction of the hairspring arrangement according to the invention.

Reference will now be made to FIG. 2 which shows in an axial cross sectional view an embodiment of the present invention. The hub, as a unit marked 22, comprises a unitary hub **22*a* to which the inner end of the hairspring 24*a* is fastened. The term unitary hub is being used herein to mean a hub that is not divided into several parts, for example a metal washer or ringlike element, and which is capable of being affixed to a balance wheel staff 14 about the hole or aperture portion therein. Such a unitary hub, it will become apparent, substantially reduces the manufacturing costs of the known hub arrangement. The hairspring 24*a* is a conventional or common metal hairspring. And for example, by inserting it into a slot of the unitary hub 22*a* and deforming the sidewalls of the slot it is clamped or attached to the unitary hub 22*a*. The unitary hub 22*a* is affixed to and thereby is electrically connected with the staff 14 about its hole or aperture or drilled portion 22*d* provided in or through the hub. In this manner, the unitary hub 22*a* and the hairspring 24*a* form an inner conductor 22*a*, 24*a* which is electrically connected with the staff 14**.

The unitary hub **22*a* and the hairspring 24*a* are both covered by a joint or single insulating mantle 24*b*. The insulating mantle 24*b*, for example, is formed from a synthetic film which is applied by electrophoresis or vacuum vaporizing which is then hardened by heat. The insulating mantle 24*b* is then treated in a conventional manner, so that it can be sheathed or covered with a metallic layer or film, for example of nickel, to form an outer electrical conductor or mantle 24*c*. The outer conductor 24*c* is deposited or formed over the insulating mantle 24*b* in such a manner to have an aperture or opening 28 about the unitary hub's hole portion 22*d* so that it is not in electrical contact with the staff 14 or with the unitary hub 22*a*. And, in order to avoid changing the spring-like characteristics of the hairspring 24***a*, by the use of high temperatures, the outer metallic conductor 24*c* is applied by known currentless plating or electrodeposit processes. It should be mentioned further that to provide for electrical connection to the inner conductor 22*a*, 24*a* and the outer conductor 24*c* of the hairspring-hub arrangement at the outer end of the hairspring, i.e. in the area where the hairspring is fastened 30 to the bridge member 12 and the tip or small section of the hairspring 24*a* is not coated with an insulating or outer metallic mantle 24*b*, 24*c*. In this way, separate connection is possible at this fastening point 30 between each conductor 24*a*, 24*c* and the watch circuitry.

A contact member or spring 32 is mounted on an insulating bushing 31, that is itself affixed to the balance wheel unit 16, and is so formed that it touches and, therefore, is electrically connected to the outer conductor 24*c* in the area of the unitary hub 22*a*. The contact spring 32 and outer conductor 24*c* are each electrically insulated from the staff 14 and balance wheel unit 16 by means of the insulating bushing 31 and the space or opening 28 between the outer conductor 24*c* and the staff 14. An electrical conductive wire 36 is connected between the contact spring 32 and a connection pin 38. The connection pin 38, which is fastened to the balance wheel 16 by means of an insulating adhesive 40, is connected to one end of the balance wheel drive coil 18 forming a current path (i.e. via outer conductor 24*c*, contact spring 32, conductor 36, connection pin 38 and through a conductor (not shown) between the connection pin and one end of the balance wheel drive coil 18,) between the drive circuit of the electric watch and the drive coil 18. The other end of the balance wheel drive coil 18, for example, is connected to the balance wheel unit 16 which is electrically coupled, via staff 14, to the inner conductor 22*a*, 24*a* of the two conductor hairspring-hub arrangement thereby completing the electric circuit to the drive circuit (not shown). Since the contact spring 32 touches or contacts the hairspring-hub arrangement in the area of the hub 22 only, it is possible to turn the staff 14, balance wheel 16, contact spring 32 and hub 22 as a single rotary unit with respect to the hairspring 24. This is advantageous for adjustment purposes and to enable reliable electrical coupling between the hairspring-hub arrangement and the drive coil 18.

Figure 3:
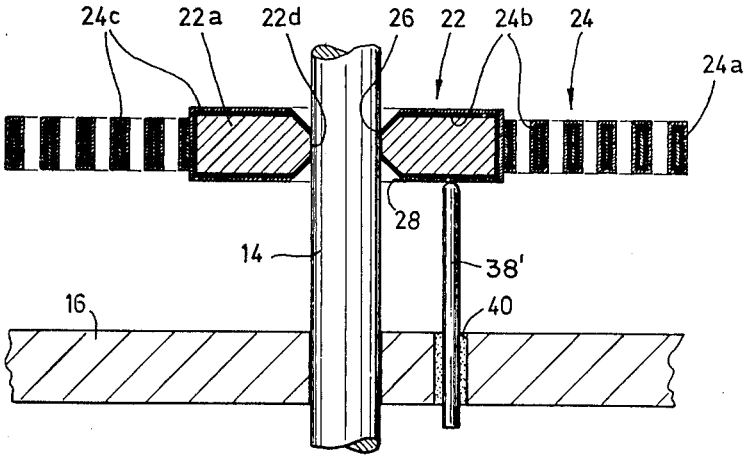
FIG. 3 is an axial cross sectional view of an alternative construction for electrically connecting a conductor of the hairspring to the balance wheel drive coil.

The type of construction according to FIG. 3 differs from that shown in FIG. 2 in that the contact member or connection pin 41 directly touches or is connected to the outer conductor mantle 24*c*.

Manufacture of the hairspring-hub arrangement according to the invention is made particularly easy and inexpensive, using customary production means, by first fastening the hairspring to the unitary hub, covering or coating the hairspring and unitary hub simultaneously with a joint coherent insulating mantle, and then applying a coherent electrical conductive mantle over the insulating mantle. This can be accomplished, for example, by pegging or masking the unitary hub hole, dipping the hairspring-hub unit into a bath to provide an insulating cover and then vaporizing a conductive metal film or layer over the insulating mantle. At the outer end or tip of the hairspring, to enable electrical connection separately to the inner and outer conductors it is feasible, for instance, to etch off the electrical conductive outer mantle of the hairspring over a certain length, and to remove here also a part of the insulation mantle by using a suitable solvent, after which a direct connection with the hairspring can be made. By clamping of the hairspring, at the outer end, in an area where the electrical conductive outer mantle is preserved, connection to the outer conductor can be made. Alternatively, the outer end could be masked prior to the formation of the coatings.

Of course, the hub hole and the outer end of the hairspring could also be made free of unwanted coatings by either masking these areas prior to formation of the coatings or removing same by any suitable process.

In any event, it can be seen that the object is to provide a hairspring-hub arrangement comprising at least an inner conductor insulated from an outer conductor mantle. The insulation and outer conductor mantles being so formed about the attached hairspring-hub to have openings therein so that separate electrical connection can be made to each of these two conductors at both ends of the attached hairspring-hub, i.e. at the hub and outer end of the hairspring.

What is claimed is:

1. A two conductor hairspring-hub arrangement for an electric watch of the type having a hairspring fastened at an inner end to a hub, wherein the improvement comprises:

a unitary hub;

a hairspring being fastened to said unitary hub, said hairspring and hub comprising an inner conductor of said arrangement;

a joint insulating mantle surrounding said inner conductor and having an aperture therein at least in an area of said hub and at an outer end of said hairspring; and means coating said joint insulating mantle for forming an outer conductor insulated from said inner conductor, said outer conductor being so formed such that separate electrical connection can be made with said inner and outer conductors at least in the areas of said hub and outer end of said hairspring wherein said apertures are being provided.

2. A hairspring-hub arrangement as in claim 1, whereby:

the unitary hub having portions defining a hole having inserted therein an electrically conductive staff member of said electric watch with electrical connection therebetween.

3. A hairspring-hub arrangement as in claim 2, whereby:

a contact element being mounted on a balance wheel makes electrical connection with the outer conductor.

4. A two conductor hairspring-hub unit for electric watches comprising:

an electrically conductive hub having a hole;

an electrically conductive hairspring being fastened at an inner end to said hub, said hairspring and hub jointly comprise a core conductor of said two conductor hairspring-hub unit;

means coating said hairspring and said hub to form an insulating mantle thereover, said means having an aperture about said hole and an aperture at an outer end of said hairspring for enabling flow of electricity therebetween via said core conductor;

means coating said insulating mantle to form an outer electrical conductor of said hairspring-hub unit, said outer conductor having an aperture about each said insulating mantle apertures and being insulated from said core conductor by said insulating mantle.

5. A method of manufacturing a two conductor hairspring-hub unit suited for use in electric watches, which comprises:

fastening an electrical conductive hairspring to an electrical conductive hub;

coating said hairspring and said hub with a joint and coherent insulating mantle;

coating said insulating mantle with a joint and coherent electrical conductive mantle; and forming openings through said insulating and said electrical conductive mantles to enable separate electrical contact with said hairspring and said hub and said electrical conductive mantle.

6. A method of manufacturing a hairspring-hub unit as in claim 5, which comprises:

placing a peg in a hole of said hub, applying by electrophoresis said insulating mantle, currentless plating said electrical conductive mantle over said insulating mantle, removing said electrical conductive mantle and said insulating mantle from a tip of an outer end of said hairspring.

* * * * *